United States Patent [19]

Chiba et al.

[11] 4,410,302

[45] Oct. 18, 1983

[54] AUTOMATIC AIR VENTING DEVICE FOR ELECTROMAGNETIC PLUNGER PUMP

[76] Inventors: Yasutsune Chiba, 2-26-9, Sannoh, Ohta-ku, Tokyo; Katsumi Nozawa, 42, Kuritaya, Kanagawa-ku, Yokohama-City, Kanagawa-Prefecture; Kenji Igarashi, 42-101, Myojindai, Hodogaya-ku, Yokohoma-City, Kanagawa-Prefecture, all of Japan

[21] Appl. No.: 244,306

[22] Filed: Mar. 16, 1981

[30] Foreign Application Priority Data

Jul. 16, 1980 [JP] Japan ..... 55-96190

[51] Int. Cl.[3] ..... F04B 49/00

[52] U.S. Cl. ..... 417/299; 417/307

[58] Field of Search ..... 417/299, 300, 307, 417

[56] References Cited

U.S. PATENT DOCUMENTS

| | | | |
|---|---|---|---|
| 3,948,147 | 4/1976 | Sauer et al. | 417/299 |
| 4,021,152 | 5/1977 | Toyoda | 417/311 |
| 4,150,924 | 4/1979 | Toyoda | 417/417 |
| 4,269,572 | 5/1981 | Nozawa et al. | 417/299 |

*Primary Examiner*—Larry I. Schwartz

*Attorney, Agent, or Firm*—Kane, Dalsimer, Kane, Sullivan & Kurucz

[57] ABSTRACT

An automatic air venting device including a venting cylinder communicating with the pressure side of an electromagnetic plunger pump down-stream of a discharge valve thereof, a valved plunger fitted in the venting cylinder for sliding reciprocatory movement, a valve mounted at an end of the valved plunger on the side of a return port, a valve seat located at the return port and adapted to be engaged by the valve when the internal pressure of the pump is above a predetermined value during operation of the pump, a spring urging the valve to be brought out of engagement with the valve seat, and a leak passage formed in the valved plunger for bringing the pressure side of the pump into communication with the return port when the valved plunger is urged by the spring to move in a direction in which the valve is brought out of engagement with the valve seat. When the internal pressure of the valve drops below the predetermined value as the pump draws air at initial stages of operation or draws air bubbles entrained in the liquid during operation of the pump, the valve is brought out of engagement with the valve seat and the pressure side of the pump is communicated with the return port through the leak passage, the air or air bubbles in the liquid are rapidly vented through the return port.

8 Claims, 4 Drawing Figures

AUTOMATIC AIR VENTING DEVICE FOR ELECTROMAGNETIC PLUNGER PUMP

BACKGROUND OF THE INVENTION

This invention relates to electromagnetic plunger pumps, and more particularly it is concerned with an automatic air venting device for an electromagnetic plunger pump suitable for use with an electromagnetic plunger pump when the latter is used with a gun type burner, for example, in which the pump delivering small quantities, such as an electromagnetic plunger pump, that has a relatively large number of strokes of the plunger per unit hour with a small length of the strokes operates to draw by suction volatile fuel oil, such as kerosene, light oil, etc., from a fuel tank located in a lower position than the position in which the pump is located, to feed such fuel under pressure and eject it in atomized particles for combustion.

The air venting device according to the invention has particular utility when used with a pump of what is generally referred to as the free piston type, such as an electromagnetic plunger pump to be described in the explanation of the embodiment of the invention, which has a plunger supported between two springs for reciprocatory movement as subsequently to be described in detail whose strokes have their lengths automatically varied by the pressure of the fluid, flow resistance and whether the springs are compressive or noncompressive.

In this type of pump, when the aforesaid fuel oil is drawn by suction from a fuel tank located in a position lower than the position of the pump and fed under pressure to a combustion system, such as boiler, hot water feeding system, heater, etc., to eject the fuel in atomized particles through a nozzle for combustion, there has arisen a problem that the phenomenon of what is referred to as vapor lock occurs due to vaporization of the fuel caused by the suction negative pressure of the pump when the residual air in the fuel is separated or when the fuel oil flows through a feed line. One example of piping involved in this phenomenon will be described by referring to FIG. 1. Fuel oil 106 in a fuel tank 105 is drawn by suction, as a pump 101 is actuated, through a suction line 103 and a strainer 102 by opening an ON-OFF valve 104. The fuel oil 106 flows through a discharge line 107 and is ejected from a nozzle 108 of a combustor in atomized particles ignited by an ignition coil, not shown, of the spark ignition type, so that combustion takes place in the combustor. In this type of combustion system, the suction head of the pump is over 2 meters and sometimes reaches several meters and the horizontal distance of the piping between the pump 101 and the fuel tank 105 exceeds ten meters. Moreover, the suction line 103 has a relatively large inner diameter and usually pipes of $\frac{3}{8}''$ are used in many cases. Thus in some cases, the suction line 103 has a large internal volume with a diameter of over 10 mm or a diameter of $\frac{1}{2}''$ in the case of steel pipes. On the other hand, in this type of pump, the discharge plunger is small in diameter and cross-sectional area and has a very short stroke, so that the volume of fluid delivered by each stroke is very small and volume efficiency is low. When the pump has to cope with compressive fluid, such as air, or fuel in a gaseous state produced by vaporization of the liquid fuel, the pump is low in efficiency because it merely repeats expansion and compression thereof. Particularly when the fuel oil fills the discharge line up to an orifice of a small diameter, such as the nozzle, on the discharge side of the pump, it takes time for the pump to remove air and gasified fuel therefrom. This gives rise to what is referred to as vapor lock in and between the suction valve, pressure chamber and discharge valve, rendering the pump inoperative because the supply of fuel oil is blocked. When this phenomenon occurs, it takes time to restore the pump to its normal operating condition, so that the pump of the aforesaid suction conditions can be hardly put to practical use. When a trap 110 of the inverted U shape is connected to the piping to keep clear of an obstacle to piping between the fuel tank and the pump, the aforesaid gas tends to stagnate in this portion of the piping and its volume gradually increases until it suddenly separates itself from this portion of the piping and enters the suction side of the pump to cause vapor lock to occur, thereby interfering with the operation of the pump.

When the suction line has a great length as aforesaid, difficulties presently to be described have been experienced. In case the fuel in the fuel tank has been consumed and the tank has to be replenished or the oil in the fuel tank is drawn therefrom for the first time, the suction line is filled with air which must be removed by drawing before the fuel oil can be drawn by suction. To this end, an air vent valve is mounted on the discharge side of the pump which is opened before the pump is started. Also, when vapor lock occurs due to collection of gas in the suction line during operation of the pump, the air vent valve must be opened manually to vent air from the suction line.

To avoid these difficulties when this type of electromagnetic plunger pump is utilized for feeding fuel oil in atomized particles to the combustor, various requirements have had to be met. These requirements include minimization of the suction head, minimization of the horizontal distance between the pump and the fuel tank and limitation of the inner diameter of the suction line to a value in the range between 4 and 6 mm. Unless these requirements are met, trouble has often occurred in the operation of the pump.

SUMMARY OF THE INVENTION

This invention has been developed for the purpose of obviating the aforesaid disadvantages of the prior art. Accordingly, an object of the invention is to provide an electromagnetic plunger provided with an automatic air venting device capable of rapidly drawing by suction and venting through a return line to the atmosphere air in the suction line disposed therein when the pump initiates an operation of drawing liquid and gas entrained in the liquid in passages on the suction side including the suction line during operation of the pump.

Another object is to prevent premature fuel feeding through a nozzle on the discharge side of the pump that occurs at initial stages of operation of the pump and delayed fuel feeding through the nozzle that occurs at terminating stages of operation of the pump.

Still another object is to enable the fuel-air mixture to be ignited while the pump delivery pressure is still low at initial stages of pump start up to reduce the explosive noise occurring at the time of ignition.

According to the invention, there is provided, in an electromagnetic plunger pump incuding an electromagnetic coil, and an electromagnetic plunger mounted in sliding reciprocatory movement in a guide case extending through the electromagnetic coil on its center axis, the sliding reciprocatory movement of the electromagnetic plunger being caused by an intermittent magnetic attracting force produced by energization of the electromagnetic coil with a pulse current and the biasing force of a return spring, so as to enable a pumping action to be performed with the cooperation of a suction valve and a discharge valve actuated simultaneously as energization of the electromagnetic coil, an automatic air venting device comprising a venting cylinder communicating with the pressure side of the pump downstream of the discharge valve of the pump, a valved plunger fitted in the venting cylinder for sliding reciprocatory movement and formed at one end portion with a leak passage communicating the pressure side of the pump with a return port, a valve mounted at the other end of the valved plunger facing return port, a valve seat arranged on the return port adapted to be brought into and out of engagement with the valve, a first spring mounted between the valved plunger and the return port for urging the valve to be brought out of engagement with the valve seat to open the valve, and a return passage provided outside a pump body separately from an intake passage, wherein the valve is operative to be closed as it is brought into engagement with the valve seat when the internal pressure of the pump rises above a predetermined value during operation of the pump and the leak passage allows gas and liquid to flow therethrough only when the pressure and the flow rate of the liquid on the pressure side of the pump drops below predetermined values due to entrainment of the gas in the liquid as the valve is brought out of engagement with the valve seat by the biasing force of the spring, to thereby cause the gas or the liquid with gas entrainment to flow through the return port and the return passage to be vented from the pump.

DESCRIPTION OF THE PREFERRED EMBODIMENT

Preferred embodiments of the invention will now be described as being incorporated in an electromagnetic plunger pump of the free piston type by referring to the accompanying drawings.

Figure 2:
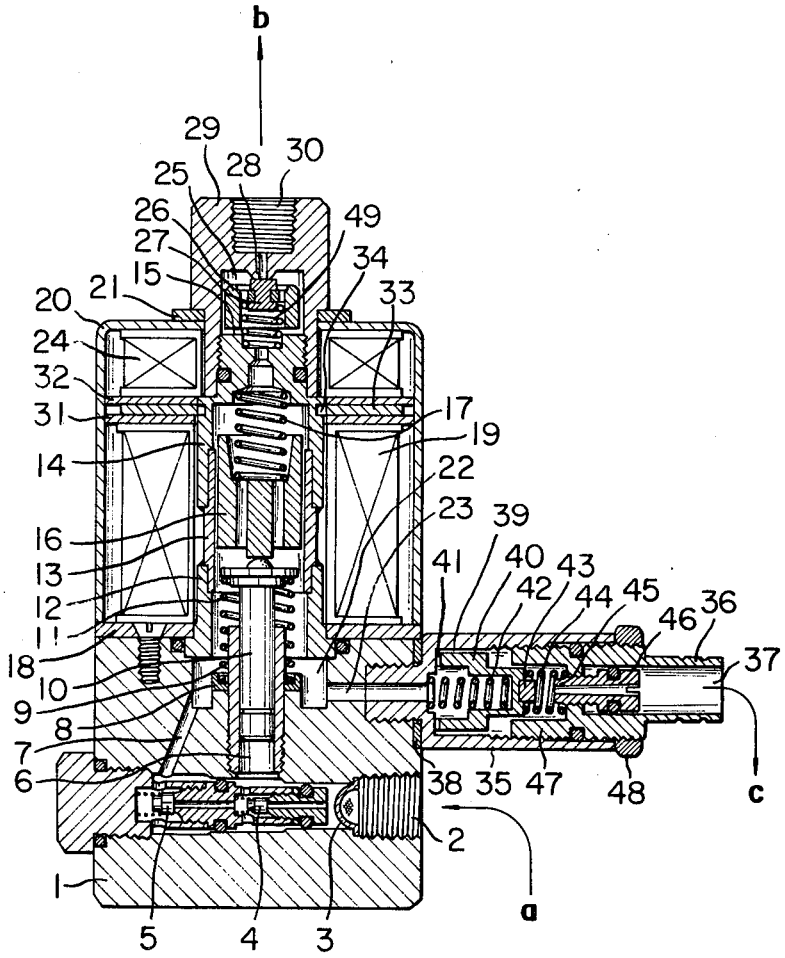
FIGS. 2 and 3 are longitudinal sectional views of the electromagnetic plunger pump with the automatic air venting device respectively comprising first and second embodiments of the invention.

Referring to FIG. 2, a guide case 13 is located on the center axis of an electromagnetic coil 19 between an annular magnetic path 14 and an annular magnetic pole 12 disposed at opposite ends of the electromagnetic coil 19 in juxtaposed relation and has fitted therein an electromagnetic plunger 16 which moves in sliding reciprocatory movement therein as a main drive member of the pump. A pump body 1 is formed in the central portion thereof with a cylinder 9 having fitted therein a discharge plunger 10 for sliding reciprocatory movement to function as an ancilary drive member of the pump. In place of providing the discharge plunger 10 serving as an ancilary drive member of the pump movable in reciprocatory movement together with the electromagnetic plunger 16 serving as a main drive member, the electromagnetic plunger 16 may be formed therein with a cylinder or the cylinder 9 may be coupled thereto to secure a hollow piston having therein a check valve in the position in which the discharge plunger 10 is disposed as shown. If desired, the electromagnetic plunger 16 may concurrently serve as a discharge plunger and the discharge plunger 10 may be eliminated, without causing any trouble in the operation of the pump.

A discharge coupling 29 is threadably connected to an upper end portion of the annular magnetic path 14, and the electromagnetic coil 19, an electromagnetic valve coil 24 located in superposed relation to the electromagnetic coil 19 coaxially therewith, a coil cover 20 enclosing the two coils 19 and 24 and a magnetic washer 21 are held and threadably connected together between the discharge coupling 29 and a magnetic-path plate 18 threadably secured to the pump body 1. The electromagnetic plunger 16 and the discharge plunger 10 are supported under pressure by an auxiliary spring 17 and a return spring 11 between the top of a hollow space of the magnetic path 14 and a spring seat 8 at the bottom of an inner chamber 22 in the central portion of the pump body 1.

The pump body 1 has mounted therein a suction valve 4 with a valve seat and a spring for urging the suction valve 4 into engagement with the valve seat, and a discharge valve 5 with a valve seat and a spring for urging the discharge valve into engagement with the valve seat. An inlet port 2 is communicated, through the suction valve 4, a pressure chamber 6 in the cylinder 9, discharge valve 5, an angling pressure duct 7, inner chamber 22, guide case 13, a bore in the electromagnetic plunger 16, a space in the annular magnetic path 14, a port formed in an attracting surface 15 at an upper end of the annular magnetic path 14, and a bore formed in an electromagnetic movable member 26 mounted in a valve chamber 25 in the discharge coupling 29 in juxtaposed relation to the attracting surface 15 and having a valve 27 pressed by the biasing force of a spring 49 against a valve seat 28 formed in the valve chamber 25, with an outlet port 30 formed in the discharge coupling 29. The aforesaid fluid passage is kept airtight with respect to the atmosphere.

In the electromagnetic plunger pump of the aforesaid construction, there is the disadvantage that vapor lock would occur when the suction line connected to the inlet port 2 is elongated and the suction head is great or when there is a trap of the inverted letter U shape in the suction line. The discharge plunger 10 has a small cross-sectional area, and this type of pump is used in most cases as a pump for delivering small quantities of fluid in which a pulse current of relatively short cycle is applied to the electromagnetic coil by half-wave rectification from a commercially available AC power source or by using a pulse oscillator of the switching system. In this application, the plunger has a large number of strokes per unit hour and consequently each stroke has a short length, so that the delivery is small in volume and volume efficiency is low. Thus the pump would be suitable for handling a noncompressible fluid, but when a compressive gas is handled the gas would be merely repeatedly expanded and compressed in the cylinder. Particularly in an application in which a nozzle of a small diameter is mounted on the discharge side, the phenomenon of vapor lock would tend to occur when a relatively large quantity of gas is drawn by suction through the inlet port while the residual fuel oil or other liquid remains in the outlet side, in the same manner as when the discharge side is blocked. When this condition occurs, it would take a long period of time before normal pumping operation can be performed again.

In such a case, the liquid on the discharge side will have its pressure abruptly reduced when the pump draws gas by suction, so that the internal pressure of the cylinder and guide case drops and the resistance offered by the fluid to the plungers is reduced, so that the lengths of the strokes of the two plungers are automatically increased by the characteristics of the free piston type pump.

Assume that the pump is operated by a current from a commercially available AC power source of 60 Hz applied to the electromagnetic coil following half-wave rectification with a discharge pressure of 7 kg/cm$^2$ (100 psi) and a delivery of 1.5 GPH in atomized particles through the nozzle ($3.785\ l \times 1.5 \times \eta = 5.4$, where $\eta$ is the coefficient when kerosene is used). In this pump, the length of the strokes of the plunger is as follows when the diameter of the discharge plunger is 5 mm and the pump has an efficiency of 0.8:

$$5400/\frac{0.5^2}{-4}\pi \times 60^3 \times 0.8 = 1.6 \text{ mm.}$$

At idling, the strokes will have a length in the range between 7 and 10 mm, so that the quantity of vented air can be increased fivefold to sixfold when there is no oil on the discharge side. Based on this discovery, the present invention has been developed and provides an automatic air venting device for an electromagnetic plunger pump which is operative to automatically open an air vent in the event that the internal pressure of the pump drops due to vapor lock, to return the fluid through a return line to a tank and at the same time to automatically extend the strokes of the plungers to release the fluid as quickly as possible.

The aforesaid air venting device is mounted according to the invention on the pressure side of the fluid downstream of the outlet valve 5 to accomplish the object. More specifically, the embodiment shown in FIG. 2 comprises a valve member 35 including a venting cylinder 39 threadably connected to the pump body 1 and maintained in communication with the inner chamber 22 of the pump body 1 through a duct 23. The venting cylinder 39 may be built in the pump body 1. The venting cylinder 39 has fitted therein for sliding reciprocatory movement a valved plunger 40 formed with two leak grooves 41 arranged radially on one end portion thereof facing the pressure side of the pump and two grooves 41 arranged axially on the outer periphery thereof and having a valve 43 on the other end opposite the one end of facing a return port 37. In place of the leak grooves 41, a gap serving as a leak passage may be provided between the venting cylinder 39 and the valved plunger 40. A return pipe coupling 36 is threadably fitted at a threaded portion 47 in the valve body 35, and the valved plunger 40 is held under pressure between the bottom of the venting cylinder 39 in the valve body 35 and the left end of a bore in the return pipe coupling 36 through springs 42 and 44.

The return pipe coupling 36 has mounted in its bore a valve seat member 46 formed at its left end with a valve seat 45 positioned against the valve 43 of the valved plunger 40. The interior of the pump body 1, valve body 35 and the return port 37 of the pipe coupling 36 is kept airtight with respect to the atmosphere. 46 is a lock nut. A leak passage is provided from the pressure side of the pump to the return port 37. The leak passage may be in any one of the forms presently to be described. A gap may be formed between the inner side of the venting cylinder 39 and the outer side of the valved plunger 40. Leak grooves may be formed on the inner wall surface of the venting cylinder 39 or the outer periphery of the valved plunger 40. A leak port may be formed in the valved plunger 40. To enable air to be returned through such leak passage to the return port 37 when the pump has drawn air by suction through the inlet port 2 and the internal pressure of the pump drops with a concomitant reduction in the delivery of liquid by the pump, the cross-sectional area and length of the leak passage or the area of a wet port should be optimally decided with respect to the composite biasing force of the springs 42 and 44.

Experiments were conducted by using kerosene with the delivery pressure and flowrate of 7 kg f/cm$^2$ and 5.4 l/H respectively. With this pump, attempts were made to drawn air by suction through the suction side and to move the valve 43 away from the valve seat 45 to open the valve seat 45 when the delivery pressure dropped to 3 kg f/cm$^2$, to release the air to the atmosphere through the return port 37. The results of the experiments show that the leak passage 41 was not necessary for successfully venting the air to the atmosphere when the venting cylinder 39 had a diameter of 12 mm, the valved plunger 40 had a diameter of 11.8 mm and the valved plunger 40 had a length of 10 mm.

Operation of an electromagnetic plunger pump of a free piston type incorporating therein the automatic air venting device according to the invention will now be described by referring to FIG. 2.

Figure 1:
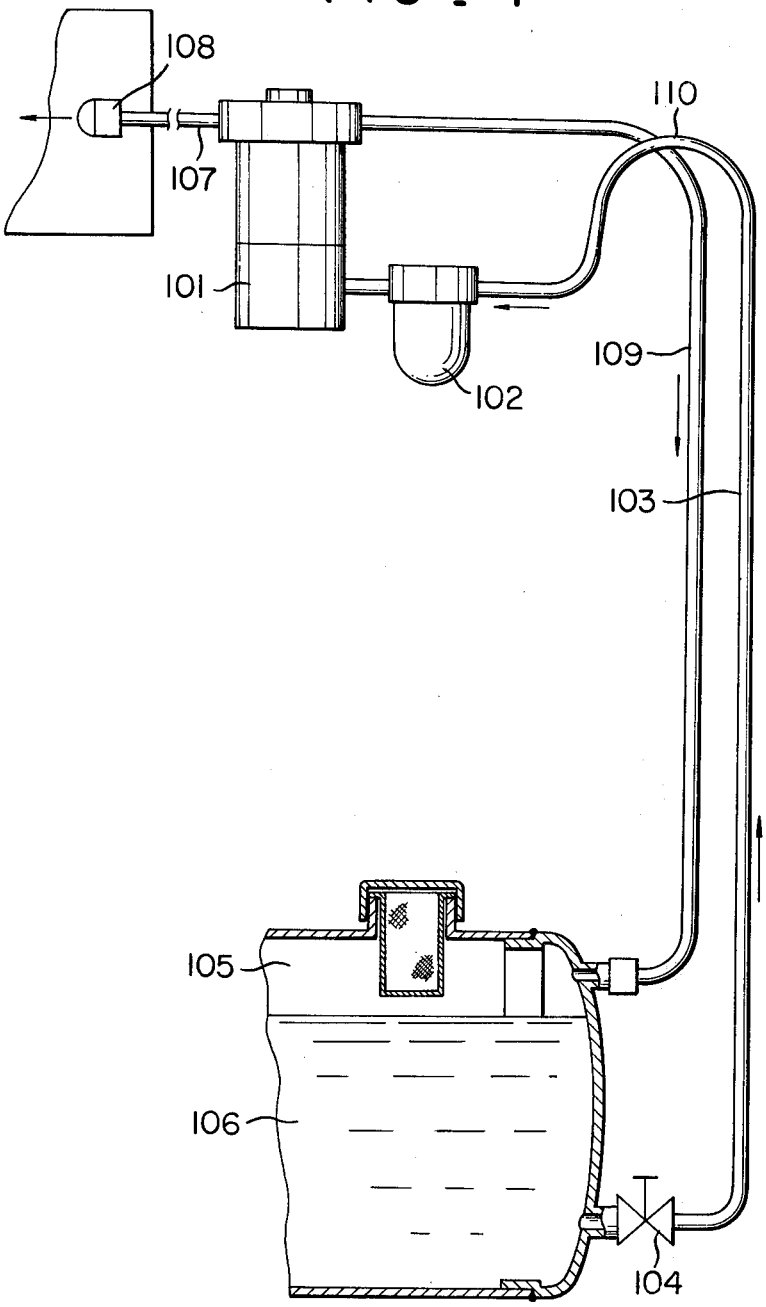
FIG. 1 is a schematic view showing the electromagnetic plunger pump provided with an automatic air venting device according to the invention being incorporated in a combustion system.

When a current from a commercially available AC power source subjected to half-wave rectification or an intermittent pulse current from other pulse oscillator circuit is applied to the electromagnetic coil 19 and the electromagnetic valve coil 24 wound in the same direction as the coil 19 and connected in series therewith, the electromagnetic plunger 16 and the discharge plunger 10 move in sliding reciprocatory movement as an intermittent magnetic attracting force generated in the coils 19 and 24 and the biasing force of the return spring 11 alternately act on the plungers 16 and 10. Coupled with the suction valve 4 and the discharge valve 5 that are opened and closed, the plungers 16 and 10 perform a pumping action, so that the electromagnetic movable member 26 is attracted to the attracting surface 15 of the annular magnetic path 14 and the valve 27 keeps the valve seat 28 open, to allow the fluid drawn by suction through the inlet port 2 in the direction of an arrow a to pass through a filter 3, suction valve 4, pressure chamber 6, discharge valve 5, angling pressure duct 7, inner chamber 22, guide case 13, and bores formed in the electromagnetic plunger 16, annular magnetic path 14, electromagnetic movable member 26 and discharge coupling 29, to be discharged in the direction of an arrow b through the outlet port 30. When the nozzle connected to the discharge side of the pump has a small diameter and gas is drawn through the suction side with the nozzle being filled with liquid or with the suction side line being empty, the internal pressure of the inner chamber 22 does not rise until the gas is discharged by drawing same, so that the valved plunger 40 in the venting cylinder 39 is pressed against the bottom of the venting cylinder 39 on the left in FIG. 2 by the biasing force of the spring 44. Thus the air passes through the gap between the venting cylinder 39 and the valved plunger 40 or a leak passage formed separately, the valve 43 which is out of engagement with the valve seat 45 and the return port 37 to flow in the direction of an arrow c through a return line 109 to a portion of an oil tank 105 above the liquid level therein communicating with the atmosphere (see FIG. 1).

Meanwhile the liquid pressure in the guide case 13 and the cylinder 9 drops and the gas is introduced thereinto to reduce the resistance offered by the liquid pressure to the plungers 16 and 14 so that the lengths of the strokes of the electromagnetic plunger 16 and the discharge plunger 10 are automatically increased, to allow the gas to be drawn and discharged with increased speed. Following release of the gas through the return port 37, liquid is drawn by suction through the inlet port 2 and the internal pressure of the pump rises, when the wet port of the leak passage for the air is wet with the liquid and the leak passage is blocked by the viscosity and tension of the liquid. Thus the fluid pressure of the liquid overcomes the biasing force of the spring 44 and presses the valved plunger 40 rightwardly in FIG. 2 against the biasing force of the spring 44, to bring the valve 43 into engagement with the valve seat 45. The opening and closing of the valve seat 43 as the valve 43 is brought out of or into engagement with the valve seat 45 can be controlled in such a manner that the valve 43 will be opened after the valve 43 is brought out of engagement with the valve seat 45 when the internal pressure of the pump reaches 4 kg f/cm$^2$ or will be opened when the internal pressure of the pump reaches 3 kg f/cm$^2$ which is a minimum pump delivery pressure at which the atomized particles released from the nozzle become so large in size that the combustion condition of the combustion system is greatly deteriorated. To this end, the threaded portion 47 of the pipe coupling 36 is turned either rightwardly or leftwardly to adjust the biasing force of the spring 44. Also, fine adjustments of the pressure may be effected by turning the valve seat member 46 threadably fitted in the return pipe coupling 36 to adjust the spacing between the valve seat member 46 and the valve 43.

The spring 42 performs the dual function of absorbing shock when the valved plunger 40 abuts against the left end or bottom of the venting plunger 40 and serving as a composite spring with the spring 44. More specifically, when the valved plunger 40 moves leftwardly in FIG. 2 by bringing the valve 43 out of engagement with the valve seat 45, the contraction of the spring 44 is reduced and its biasing force is reduced accordingly while the contraction of the spring 42 increases and its biasing force is increased accordingly, so that the valved plunger 40 can be pressed leftwardly with a load lower than the biasing force of the spring 42 alone. Conversely, when the valved plunger 40 moves rightwardly to bring the valve 43 into engagement with the valve seat 45, the load applied by the spring 42 is reduced and the load applied by the spring 44 is increased. Thus when one considers the load of the composite spring relative to the contractions of the two springs when the valved plunger 40 shifts rightwardly or leftwardly from the position in which the biasing forces of the two springs balance, the result achieved by using the two springs is similar to the result obtained by using a single spring of a higher spring constant than the two springs (see Japanese Patent Publication No. Sho 53-10282 and U.S. Pat. No. 4,150,924). Thus it is possible to provide a relatively high load with a combination of springs of a low spring constant and contracting such springs less than would otherwise be required. This offers the advantages that fatigue of the springs that would result from contracting them to a greater extent can be avoided and that the space for mounting the springs can be reduced.

When it is not necessary to adjust the pressure at which the valve 43 is opened or closed, the spring 42 may be eliminated, and the threaded portion 47 for adjusting the contraction of the spring 44 and the threaded portion of the valve seat member 46 for adjusting the spacing between the valve 43 and the valve seat 45 can also be eliminated.

When the internal pressure of the pump gradually rises following the engagement of the valve 43 with the valve seat 45, the liquid fuel is ejected in atomized particles through the nozzle at a predetermined pressure or 7 kg f/cm$^2$, for example, to which the discharge pressure is adjusted by a pressure adjusting mechanism, not shown, of the pump.

Upon cutting off the supply of current to the electromagnetic plunger and the electromagnetic valve plunger 24 to interrupt the combustion taking place in the combustion system, the electromagnetic plunger 16 and the discharge plunger 10 are de-actuated and at the same time the electromagnetic movable member 26 in the valve chamber 25 is released from engagement with the attracting surface 15 by the biasing force of the spring 49 because of the absence of a magnetic force, to allow the valve 27 to come into engagement with the valve seat 28 to block the discharge side of the pump.

At this time, the internal pressure of the pump is equal to the delivery pressure of the pump because the valve 43 is also in engagement with the valve seat 45.

The magnetic circuit formed by the two coils 19 and 24 will be described. As shown, the electromagnetic coil 19 for operating the pump and the electromagnetic coil 24 for operating the electromagnetic movable member 26 are arranged axially in spaced juxtaposed relation with a disc-shaped nonmagnetic member 33 being interposed between disc-shaped magnetic paths 31 and 32 forming part of the magnetic circuit. The disc-shaped nonmagnetic member 33 is formed with an annular groove 34 in a part thereof which is adjacent the annular magnetic path 14 to reduce the size of the magnetic path 14 in this position to increase magnetic resistance. By this arrangement, even if the two coils 18 and 24 are wound in the same direction and connected in series with each other, the magnetic path for operating the electromagnetic plunger 16 follows a looth connecting the disc-shaped magnetic path 31, annular magnetic path 14, electromagnetic plunger 16, annular magnetic pole 12, magnetic path lower plate 18 and coil cover 20. The magnetic path for operating the electromagnetic movable member 26 follows a loop connecting the coil cover 20, magnetic washer 21, electromagnetic movable member 26, top of annular magnetic path 14 and disc-shaped magnetic path 32. Thus the magnetic fluxes passing through the two disc-shaped magnetic paths 31 and 32 are oriented in opposite directions. Owing to this feature, the residual magnetism on the disc-shaped magnetic path 31 and the residual magnetism in the disc-shaped magnetic path 32 cancel each other out to permit the electromagnetic movable member 26 to be quickly and positively brought out of engagement with the attracting surface 15 to block the discharge side passage when the supply of current to the two coils 19 and 24 is interrupted to shut down the pump. When a current is passed to the two coils 19 and 24, there is no risk of the magnetic flux of one magnetic path for one coil entering the other magnetic path for the other magnetic coil or vice versa and the magnetic fluxes are prevented from interfering with each other, so that the electromagnetic valve and electromagnetic pump can normally operate at all times. When the two coils 19 and 24 are energized by a continuous current, such as a half-wave rectified current, a magnetic force is produced by an induction electromotive force of a phase lag in the vicinity of the attracting surface 15 above the annular magnetic path 14 when the current is interrupted at each ½ cycle. This magnetic force makes up for the magnetic force tending to disappear from the magnetic path when the supply of current is interrupted and permits the electromagnetic movable member 26 to be continuously attracted to the attracting surface 15. Thus the disappearance of the magnetic force from the magnetic path is essentially limited to a very short time, with the result that the electromagnetic movable member 26 is kept in engagement with the attracting surface 15 without being released from engagement therewith even if the supply of current is interrupted. This offers the advantages that chattering and buzzing of the electromagnetic movable member 26 are inhibited to prevent noise production and that the damage to the electromagnetic movable member 26 and the attracting surface 15 and wear on the valve 27 and valve seat 28 can be avoided.

By the interrupting action of the electromagnetic valve, the discharge pressure of the pump gradually drips with the pump is shut down, so that the electromagnetic valve is capable of avoiding environmental disruption. That is, deposition of soot on the nozzle and hardening thereof due to droplets of fuel oil dropping through the nozzle after the pump is shut down can be avoided, so that the nozzle can be kept in good condition without being obturated to enable the fuel oil to be atomized satifactorily to carry out complete combustion without producing offensive odor of gas by incomplete combustion.

However, since the internal pressure of the pump is kept at substantially the same level as the discharge pressure of the pump during pump shut down, there is the disadvantage that when the pump is actuated for performing another combustion operation the electromagnetic valve is instantly opened and allows the fuel oil to be discharged in atomized particles at steady state pressure, so that the noise produced at the time the fuel is ignited is high. This is because the volume of discharged fuel oil from the nozzle is in proportion to the square root of the discharge pressure, and higher the pressure the greater is the flow rate of fuel discharge. As the fuel discharged in high flow rate is ignited, ignition occurs instantly and the fuel is exploded. Nowadays means is provided for delaying a rise in the pressure of the pump at initial stages of operation to permit the fuel oil to be ignited in an atomized condition in which the volume of fuel discharged in atomized particles or the discharge pressure is barely enough to allow ignition to take place, and the pressure of the pump is raised to a steadystate discharge pressure level following ignition.

Figure 3:
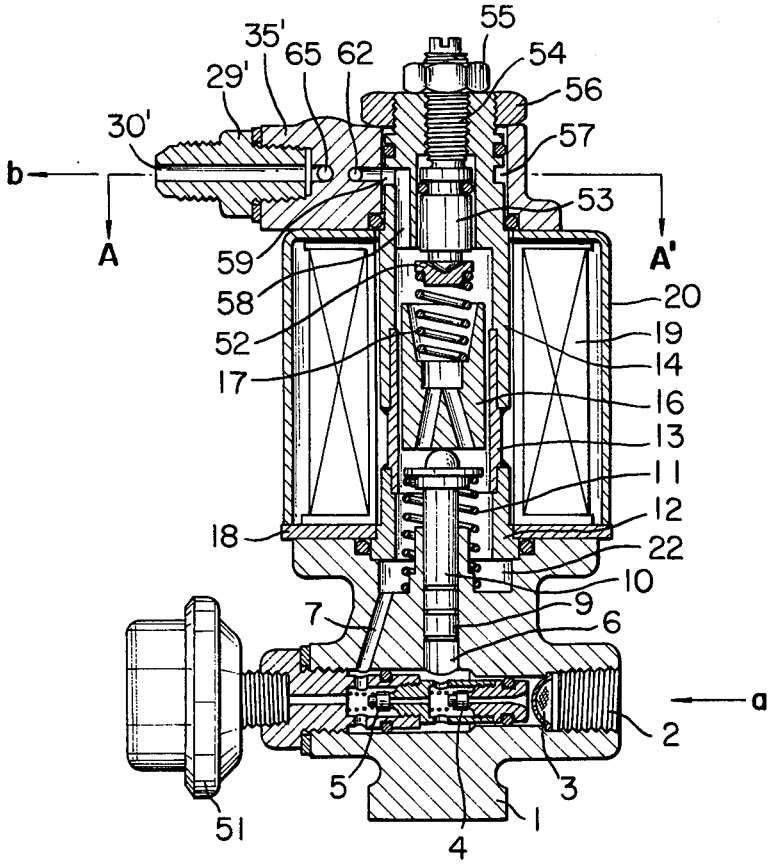
Figure 4:
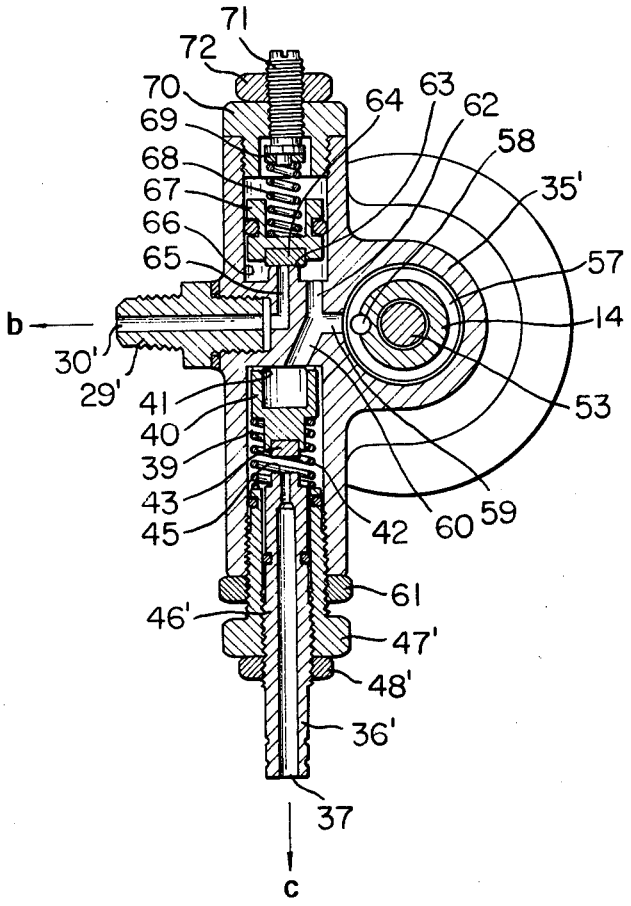
FIG. 4 is a transverse sectional view, taken along the line A—A in FIG. 3.

FIG. 3 and FIG. 4 show another embodiment of the electromagnetic plunger pump provided with a fuel shutoff valve in addition to an tutomatic air venting valve, so that the pump is provided with the function of inhibiting the generation of fuel explosion noises as well as the function of automatically venting air by allowing the fuel oil to be ignited at early stages of pump operation while the pump still has a relatively low discharge pressure.

As shown, the electromagnetic plunger pump includes a valve body 35' that is secured in place by a clamp nut 56 threadably connected to an externally threaded portion of the top of the annular magnetic path 14 on the coil cover 20, without using an electromagnetic valve structure. An adjusting rod is threadably connected through an adjusting screw 54 to the annular magnetic path 14, so that as the adjusting rod is rotated the sum of the contractions of the auxiliary spring 17 and return spring 11 to adjust the magnetic gap between the lower end of the electromagnetic plunger 16 and the annular magnetic pole 12, the balancing of the attracting force of the solenoid and the biasing forces of the springs and the length of the strokes depending on the flowrate of the delivery by the pump, to thereby regulate the discharge pressure of the pump to a predetermined value. 55 is the lock nut for the adjusting screw 54, and 51 is an accumulator for smoothening the pulsations of delivery by the pump and storing power.

The valve body 35' has built-in automatic air venting and shutoff valves. A duct 58 formed at the top of the annular magnetic path 14 is communicated with a duct 59 through an annular groove 57, and the duct 59 branches into two ducts 60 and 62, the duct 60 communicating with the automatic air venting valve and the duct 62 communicating through the shutoff valve with a discharge port 30' formed in a discharge coupling 29'.

Parts in FIG. 3 that are similar to those shown in FIG. 2 are designated by like reference characters and operate in the same manner as the corresponding parts in FIG. 2.

FIG. 4 is a transverse sectional view taken along the line A–A' in FIG. 3 wherein the duct 60 communicates with the air venting cylinder 39 having the valved plunger 40 fitted therein, and the spring 42 is mounted between an adjusting screw 47' threadably connected to the valve body 35' and the plunger 40. The valve seat 45 adapted to engage the valve 43 is provided at the upper open end of a return pipe coupling 36' threaded into the adjusting screw 47'. The adjusting screw 47' can be rotated to adjust the contraction of the spring 42 in accordance with the internal pressure of the pump acting on the valved plunger 40 for opening and closing the valve 43, to thereby regulate the biasing force of the spring 42. It is possible to effect fine adjustments of the internal pressure of the pump by rotating the return pipe coupling 36' and adjusting the spacing between the valve seat 45 and valve 43.

The leak passage formed between the air venting cylinder 39 and the valved plunger 40 is similar to that described by referring to the embodiment shown in FIG. 2. 61 and 48' are lock nuts. When the biasing force of the spring 42 for operating the valved plunger 40 is set at an optimum valve beforehand with respect to the internal pressure of the pump to avoid the need to cause the valve 43 to be brought into and out of engagement with the valve seat 45, the adjusting screw 47' and the threaded portion of the return pipe coupling 36' may be eliminated.

The automatic air venting valve offers the other advantages described by referring to the embodiment shown in FIG. 2.

Meanwhile a cylinder 66 communicating with the duct 62 has fitted therein a plunger 67 in airtight relation to outside by sliding reciprocatory movement. The plunger 67 has attached to its lower end a valve 64 adapted to be brought into and out of engagement with a valve seat 63 disposed in the center of the bottom of the cylinder 66. The valve seat 63 communicates with an outlet port 30' of the discharge coupling 29' threadably connected to the valve body 35'.

A spring 68 is mounted under pressure between a recess formed in the plunger 67 at an end thereof opposite the valve 64 and a spring seat 69 of an adjusting screw 71 threadably connected to a cap screw 70 threadably connected to the valve body 35'. By turning the adjusting screw 71 to regulate the contraction of the spring 68 to vary its biasing force, it is possible to regulate the pressure at which the valve 64 is brought into engagement with the valve seat 65 in accordance with the internal pressure of the pump acting on the plunger 67. When there is no need to regulate the pressure at which the valve 64 is brought into engagement with the valve seat 65, the adjusting screw 71 may be eliminated by setting the biasing force of the spring 68 at an optimum value beforehand.

Assume that gas is drawn by suction through the suction side and the internal pressure of the pump drops to 3 kg f/cm$^2$, for example, during operation of the pump. The biasing force of the spring 42 would overcome the internal pressure of the pump and the valved plunger 40 would move upwardly in FIG. 4 to bring the valve 43 out of engagement with the valve seat 45, thereby allowing the gas to flow through the leak passage between the air venting cylinder 39 and the plunger 40. This causes the internal pressure of the pump to drop and remove the resistance which would otherwise be offered to the plungers, so that the electromagnetic plunger 16 and the discharge plunger 10 of the free piston type have the lengths of their strokes automatically increased to return the gas quickly through the return port 37 in the direction of the arrow c through the return line 109 (FIG. 1) to a space above the liquid level in the oil tank 105. At this time, the pump draws liquid by suction and the volume of liquid and the pressure reach predetermined values, so that the liquid is returned even if its pressure drops to the tank 105 by the operation transmission characteristic provided by the leak passage, valved plunger 40 and spring 42.

When the internal pressure of the pump is restored to a predetermined lower limit or 4 kg f/cm$^2$, for example, the valve 43 is brought into engagement with the valve seat 45 to allow the liquid to pass through the duct 62 into the cylinder 66 having the structure of a shutoff valve, to apply pressure to the plunger 67. If the biasing force of the spring 68 is set beforehand at a level such that when a predetermined pressure level or 5 kg f/cm$^2$, for example, is reached the valve 64 is pressed out of engagement with the valve seat 63, then the liquid flows from the valve seat 63 through the duct 65 to the outlet port 30', through which it flows in the direction of the arrow b through the discharge line 107 (FIG. 1) to be ejected through the nozzle 108 in atomized particles.

By forming the valve 64 from a relatively resilient material, such as synthetic rubber, synthetic resin, etc., it is possible to achieve the effect of reducing pressure by the throttling action of the valve 64 at the instant the valve 64 is released from engagement with the valve seat 63 to open the latter. Thus if the fuel oil in atomized particles ejected through the nozzle 108 is ignited by electric spark at this time, then it is possible to reduce the noise level of ignition of the atomized fuel because the volume of fuel ejected at this time is relatively low with the pressure in the pump being on the rise. Following ignition, the discharge pressure of the pump immediately rises to a predetermined value and is maintained at this level. Upon the pump being shut down to stop the combustion, the discharge pressure of the pump drops. However, by closing the valve seat 63 in such a manner that the supply of fuel oil is cut off at 4 kg f/cm$^2$, for example, it is possible to avoid droplets of the fuel oil dripping through the nozzle after the pump is shut down. Thus it is possible to avoid obturation of the nozzle by soot, to enable the liquid fuel to be ejected through the nozzle in satisfactory atomized conditions at all times and to prevent offensive odor from being produced due to incomplete combustion of the liquid fuel caused by driplets of the liquid fuel discharged through the nozzle following pump shut down.

The automatic air venting valve and the shutoff valve are constructed such that the fuel oil is ejected through the nozzle after the discharge pressure of the pump rises to a level at which the liquid fuel is sufficiently atomized in uniformly fine particles to be ignited by electric spark, so that it is possible to avoid combustion of the liquid fuel in poor condition and generation of offensive odor due to droplets of the liquid fuel dripping from the nozzle before the pump is actuated.

There is a difference between the pressure at which the valve 64 is brought out of engagement with the valve seat 63 to open the valve and the pressure at which the valve 64 is brought into engagement with the valve seat 64 to close the valve in the shutoff valve mechanism. This is because of the fact that since the cylinder 66 has a lower pressure receiving area when the valve seat 63 is closed by the valve 64 by an area being closed than when the valve seat 63 is open, the pressure required to move the valve 64 out of engagement with the valve seat 63 to open the valve should be higher than the pressure required to move the valve 64 into engagement with the valve seat 63 to close the valve.

From the foregoing description, it will be appreciated that the automatic air venting device according to the invention comprises a valved plunger fitted for sliding for sliding reciprocatory movement in an air venting cylinder communicating with the pressure side of the pump downstream of the discharge valve of the pump, a valve mounted at an end of the valved plunger on the side of a return port, a valve seat formed at a part on the return port side to be engaged by the valve, a spring urging by its biasing force the valved plunger to move in a direction in which the valve is brought out of engagement with the valve seat, and a leak passage formed in the valved plunger to allow the return port to communicate with the pressure side of the pump therethrough as the valved plunger is urged by the spring to move in a direction in which the valve is opened. By virtue of this automatic air venting device, when the internal pressure of the pump drops below a predetermined level as gas is drawn by suction into the pump at initial stages of pump operation or air bubbles entrained in the liquid fuel is drawn by suction during operation of the pump, the valve of the automatic air venting device is opened and the pressure side of the pump is allowed to communicate with the return port through the leak passage formed in the valved plunger, to thereby permit the gas or air bubbles to be rapidly drawn by suction and discharged through the return line, to be vented from the pump.

What is claimed is:

1. An automatic venting device for an electromagnetic plunger pump including an electromagnetic coil, and an electromagnetic plunger mounted in sliding reciprocatory movement in a guide case extending through the electromagnetic coil on its center axis, the sliding reciprocatory movement of the electromagnetic plunger being caused by an intermittent magnetic attracting force produced by energization of the electromagnetic coil with a pulse current and the biasing force of a return spring, so as to enable a pumping action to be performed with the cooperation of a suction valve and a discharge valve actuated simultaneously as energization of the electromagnetic coil, wherein said automatic venting device is arranged with a shut-off valve mechanism in a passage at the pressure side between the discharge valve of the pump and a discharge port of the pump, said automatic air venting device comprising:

a venting cylinder which is at its one end flow-connected to said passage at the pressure side of the pump and at the other end flow-connected to a return port;

a valved plunger fitted in the venting cylinder for sliding reciprocatory movement and formed at one end portion with a leak passage for gas communicating said passage at the pressure side of the pump with said return port;

a valve mounted at the other end of the valved cylinder facing said return port;

a valve seat arranged on said return port adapted to be brought into and out of engagement with the valve;

a spring mounted between the valved plunger and the return port for urging the valve to be brought out of engagement with the valve seat to open the valve; and a return passage provided outside a pump body separately from an intake passage;

said spring and said leak passage being set such that when the internal pressure of the pump rises above a predetermined pressure during operation of the pump, said leak passage is blocked by the liquid so that said valve is operative to be closed as it is brought into engagement with the valve seat, and that only when the pressure and flow rate of the liquid at the pressure side of the pump drops below the predetermined valve due to entrainment of the gas in the liquid, said lead passage allows gas or liquid containing gas to glow therethrough and the valve is brought out of engagement with the valve seat by the biasing force of the spring to thereby cause the gas or the liquid containing gas to flow through the return port and the return passage to be vented out of a pump body.

2. An automatic air venting device as claimed in claim 1, wherein said leak passage comprises grooves formed at one end portion of the valved plunger opposite the valve thereof and disposed radially and grooves formed at an outer periphery thereof and disposed axially.

3. An automatic air venting device as claimed in claim 1, wherein said leak passage comprises a gap between said venting cylinder and said valved plunger.

4. An automatic air venting device as claimed in claim 1, further comprising an adjusting screw threadably connected to the venting cylinder for adjusting the contraction of the spring for urging the valved plunger by its biasing force.

5. An automatic air venting device as claimed in claim 4, wherein said adjusting screw is formed along its center axis with an axial bore having a hollow valve seat member threadably connected to the axial bore, said valve seat member having a valve seat on an end thereof facing the valved plunger.

6. An automatic air venting device as claimed in claim 1, further comprising a recess formed at the one end portion of the valved plunger opposite the valve, and a second spring mounted between the bottom of said recess and the pump body or a valve body for urging by its biasing force the valved plunger to move in a direction opposite to the direction in which the valved plunger is urged to move by the first spring.

7. An automatic air venting device as claimed in claim 1, wherein said automatic air venting device is incorporated in the electromagnetic plunger pump in combination with an electromagnetic valve mechanism built in the pump and located in close proximity to the discharge port of the pump.

8. An automatic air venting device as claimed in claim 1, wherein said automatic air venting device is mounted, in combination with a shutoff valve mechanism, in a valve body in close proximity to the discharge port of the pump.

* * * * *